US005927549A

United States Patent [19]

Wood

[11] Patent Number: 5,927,549

[45] Date of Patent: Jul. 27, 1999

[54] DISPENSING STRUCTURE WITH FRANGIBLE MEMBRANE FOR SEPARATING TWO PRODUCTS

[75] Inventor: Christopher J. Wood, Greenfield, Wis.

[73] Assignee: AptarGroup, Inc., Crystal Lake, Ill.

[21] Appl. No.: 09/045,387

[22] Filed: Mar. 20, 1998

[51] Int. Cl.[6] ..... B65D 25/08

[52] U.S. Cl. ..... 222/83; 206/222; 215/DIG. 8; 222/129; 222/490; 222/494

[58] Field of Search ..... 222/81, 83, 129, 222/490, 494, 556, 546; 206/222; 215/DIG. 8

[56] References Cited

U.S. PATENT DOCUMENTS

| | | | |
|---|---|---|---|
| Re. 29,850 | 11/1978 | Labarre . | |
| 2,895,654 | 7/1959 | Rieke . | |
| 3,135,441 | 6/1964 | Wise et al. . | |
| 3,156,369 | 11/1964 | Bowes et al. . | |
| 3,207,375 | 9/1965 | Bereziat et al. . | |
| 3,239,112 | 3/1966 | Porcelli . | |
| 3,269,617 | 8/1966 | Goth . | |
| 3,278,089 | 10/1966 | Heekin et al. . | |
| 3,282,477 | 11/1966 | Henchert . | |
| 3,292,828 | 12/1966 | Stuart . | |
| 3,310,206 | 3/1967 | Littlefield . | |
| 3,406,872 | 10/1968 | Fiquet et al. . | |
| 3,434,620 | 3/1969 | Laurizio . | |
| 3,458,080 | 7/1969 | Laurizio . | |
| 3,459,315 | 8/1969 | Labarre . | |
| 3,495,746 | 2/1970 | Laurizio . | |
| 3,567,061 | 3/1971 | Song . | |
| 3,580,423 | 5/1971 | Gilman . | |
| 3,610,484 | 10/1971 | Matzka . | |
| 3,661,306 | 5/1972 | Kuckens . | |
| 3,802,604 | 4/1974 | Morane et al. | 222/83 |
| 3,834,597 | 9/1974 | Guala . | |
| 3,860,152 | 1/1975 | Marti . | |
| 3,912,115 | 10/1975 | Smith . | |
| 3,924,777 | 12/1975 | Peyser . | |
| 3,949,898 | 4/1976 | Patel et al. . | |

(List continued on next page.)

FOREIGN PATENT DOCUMENTS

| | | |
|---|---|---|
| 570 276 A1 | 11/1993 | European Pat. Off. . |
| 747 294 A1 | 12/1996 | European Pat. Off. . |
| WO 95/28274 | 10/1995 | WIPO . |
| WO 96/14249 | 5/1996 | WIPO . |
| WO 96/24483 | 8/1996 | WIPO . |
| WO 97/00816 | 1/1997 | WIPO . |
| WO 97/05055 | 2/1997 | WIPO . |

OTHER PUBLICATIONS

"Multi–Material Injection Saves Time, While Cutting Costs," Modern Plastics, Mar. 19, 1994 (Author: Peter Mapleston).

"Molding Many Parts Into One," Product Design and Development, Dec. 19, 1995, p. 16 (Author: Jay Rosenberg).

A copy of 2 photographs of a closure specimen, one photograph showing a top perspective view with the closure open, and the other photograph showing a bottom perspective view with the closure open.

*Primary Examiner*—Kevin P. Shaver
*Attorney, Agent, or Firm*—Rockey, Milnamow & Katz, Ltd.

[57] ABSTRACT

A dispensing structure is provided for a container which has an opening to the container interior. The structure includes a body for extending around the container opening and a membrane for occluding the container opening. A cover is disposed over the membrane and is sealingly engaged with the body to accommodate axial sliding movement from an outer position to an inwardly displaced position. The cover defines a dispensing orifice and defines an edge for severing at least part of the membrane as the cover is moved from the outer position to the inwardly displaced position. An additive material may be initially stored in the dispensing structure above the membrane and can be combined with the product in the container after the membrane has been severed. A self-sealing, pressure-openable, slit-type valve may be mounted in the cover at the dispensing orifice to control flow through the orifice.

15 Claims, 5 Drawing Sheets

U.S. PATENT DOCUMENTS 3,968,872 7/1976 Cavazza ..... 222/83 X
3,990,603 11/1976 Brochman .
4,022,357 5/1977 Dwinell .
4,179,044 12/1979 Fitte .
4,211,334 7/1980 Witten et al. .
4,234,103 11/1980 Strobl et al. .
4,294,382 10/1981 Summers et al. .
4,307,821 12/1981 McIntosh .
4,340,147 7/1982 McIntosh .
4,356,939 11/1982 Fitte .
4,483,464 11/1984 Nomura .
4,583,665 4/1986 Barriac .
4,610,374 9/1986 Buehler ..... 222/83
4,682,702 7/1987 Gach .
4,696,415 9/1987 Mueshberg .
4,709,822 12/1987 Vataru .
4,722,449 2/1988 Dubach .
4,727,999 3/1988 Gach .
4,728,006 3/1988 Drobish et al. .
4,747,501 5/1988 Greaves .
4,749,108 6/1988 Dornsbusch et al. .
4,757,916 7/1988 Goncalves ..... 222/83
4,770,305 9/1988 Su .
4,785,931 11/1988 Weir et al. .
4,795,043 1/1989 Odet et al. .
4,807,769 2/1989 Gach .
4,817,816 4/1989 Leseman et al. .
4,846,236 7/1989 Deruntz .
4,867,326 9/1989 O'Meara .
4,869,399 9/1989 Dubach .
4,909,434 3/1990 Jones et al. .
4,947,986 8/1990 Ballu ..... 206/221
4,948,003 8/1990 Munoz .
4,969,581 11/1990 Seifert et al. .
4,979,941 12/1990 Ogle, II ..... 222/83 X
4,982,875 1/1991 Pozzi et al. ..... 222/83
4,993,569 2/1991 Osip et al. .
5,005,737 4/1991 Rohr .
5,008,066 4/1991 Mueller .
5,042,690 8/1991 O'Meara .
5,090,582 2/1992 Art et al. .
5,115,950 5/1992 Rohr .
5,133,486 7/1992 Moore et al. .
5,213,236 5/1993 Brown et al. .
5,255,812 10/1993 Hsu .
5,271,531 12/1993 Rohr et al. .
5,280,764 1/1994 Levinrad .
5,292,025 3/1994 Dubreul .
5,353,928 10/1994 Schumacher ..... 206/222
5,356,018 10/1994 Dubach .
5,386,918 2/1995 Neveras .
5,388,690 2/1995 Mutterle et al. ..... 222/83 X
5,400,912 3/1995 Brown et al. .
5,427,260 6/1995 Mueller et al. .
5,437,382 8/1995 Gluckman .
5,439,124 8/1995 Mock .
5,439,143 8/1995 Brown et al. .
5,462,200 10/1995 Weiler .
5,469,980 11/1995 O'Meara et al. .
5,474,209 12/1995 Vallet Mas et al. ..... 222/83
5,482,176 1/1996 Maietta et al. .
5,501,348 3/1996 Takeuchi .
5,503,282 4/1996 Montgomery .
5,505,326 4/1996 Junko .
5,531,363 7/1996 Gross et al. .
5,547,091 8/1996 Neveras et al. .
5,566,859 10/1996 Willis et al. .
5,642,824 7/1997 Hess, III et al. .
5,642,838 7/1997 Stoody .
5,782,345 7/1998 Guasch et al. ..... 206/222

20
4
4
60
10
130
52
22
26
24
34
56
28
12

100
84
88
20
62
80
66
58
22
52
26
34
130
60
10
56
28
12

10
66
62
22
52
50
26
130
20
56
34
28
12

DISPENSING STRUCTURE WITH FRANGIBLE MEMBRANE FOR SEPARATING TWO PRODUCTS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system or structure for dispensing a product from a container. The dispensing structure is particularly suitable for use in storing an additive or additional ingredient which can be initially maintained separated from material in a container and subsequently mixed with the material in the container.

BACKGROUND OF THE INVENTION AND TECHNICAL PROBLEMS POSED BY THE PRIOR ART

A variety of container closures have been designed to accommodate opening of the closure by pulling or breaking a portion of a membrane across the container opening. While such closures may function generally satisfactorily in the applications for which they have been designed, it would be desirable to provide an improved dispensing system or dispensing structure which can be even more easily used.

Further, it would be advantageous if such an improved dispensing structure could accommodate the separate storage of an additive or ingredient for subsequent mixing with another material in the container.

Further, it would be beneficial if such improved dispensing structure could provide a readily releasable system for maintaining the structure in a sealed closed position and for providing evidence of tampering or evidence of an initiation of the closure opening process.

Additionally, it would be desirable to provide an improved closure that could, if desired, readily accommodate a design in which a frangible sealing system across the dispensing opening can be incorporated solely within a closure structure which is separate from the container to which the closure structure is attached. Advantageously, such a dispensing closure or dispensing structure should provide a very effective seal when the dispensing structure is closed (1) so as to avoid subjecting the material in the container (and/or the interior dispensing structure) to prolonged exposure to the ambient atmosphere, and (2) so as to prevent contamination of the materials within the container by preventing contaminant ingress.

Such an improved dispensing structure should also accommodate designs which permit incorporation of the dispensing structure as a unitary part, or extension, of the container and which also accommodate separate mounting of the dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for a container that has an opening to the container interior. The dispensing structure includes a body for extending around the container opening. A membrane occludes the container opening. A movable housing or cover is disposed over the membrane and sealingly engages the body to accommodate axial sliding movement from an outer position to an inwardly displaced position. The cover defines a dispensing orifice and defines an edge for severing at least part of the membrane as the cover is moved from the outer position to the inwardly displaced position.

According to one aspect of the invention, an optional, removable, tamper-evident, tear-band can be provided to initially secure the cover to the body to prevent movement of the cover toward the inwardly displaced position until the band is torn at least partly away from the cover and body.

According to another aspect of the invention, the cover and the body together define a chamber over the membrane, and an additive product may optionally be provided in the chamber for adding to the container after at least a part of the membrane is severed. The dispensing structure may be provided with the additive product in the chamber with or without a tamper-evident band securing the cover to the body.

According to a preferred embodiment of the dispensing structure, a lid is provided to close the dispensing orifice of the cover, especially in those applications wherein an additive product is initially stored within the chamber in the cover.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4 shows the dispensing closure lid in the fully closed condition (with solid lines) and shows the lid open in phantom (with dashed lines);

FIG. 8 shows the dispensing structure in the form of a dispensing closure with a lid in an open position;

DESCRIPTION OF THE PREFERRED EMBODIMENTS

Figure 1:
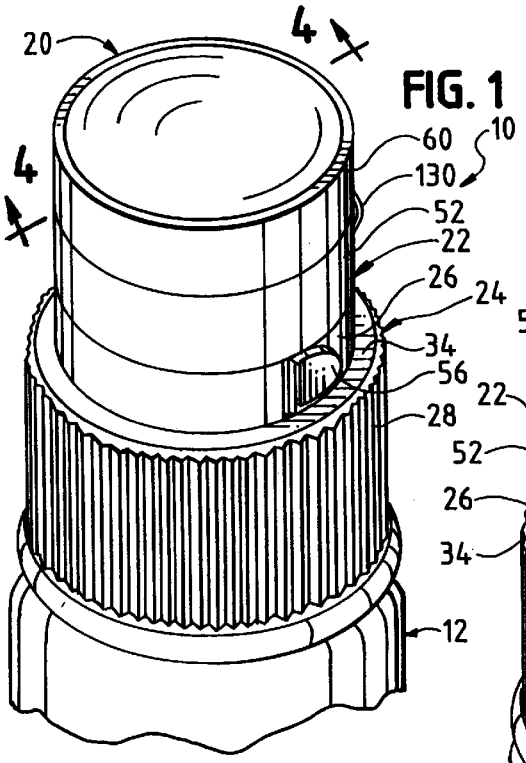
FIG. 1 is a perspective view of a dispensing structure of the present invention in the form of a dispensing closure mounted on the upper end of a container with the dispensing closure shown in an initially closed and sealed condition.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and sold in an orientation other than the position described.

One presently preferred embodiment of the dispensing structure of the present invention is illustrated in FIGS. 1–7 in the form of a dispensing closure designated generally in the figures by the reference number 10. The dispensing structure or closure 10 is provided as a separate manufactured unit for mounting to the top of a container 12. It will be appreciated, however, that it is contemplated that in some applications it may be desirable for the dispensing structure 10 to be formed as a unitary part, or extension, of the container 12.

The container 12 has a conventional mouth or opening 14 (FIG. 4) which provides access to the container interior and product 16 (FIGS. 4 and 6) contained therein. The product 16 may be, for example, a liquid comestible product. The product 16 could also be any other solid, liquid, or gaseous material, including, but not limited to, a food product, a personal care product, an industrial or household cleaning product, a paint product, a wall patch product, other chemical compositions (e.g., for use in activities involving manufacturing, commercial or household maintenance, construction, remodeling, and agriculture), etc.

Figure 4:
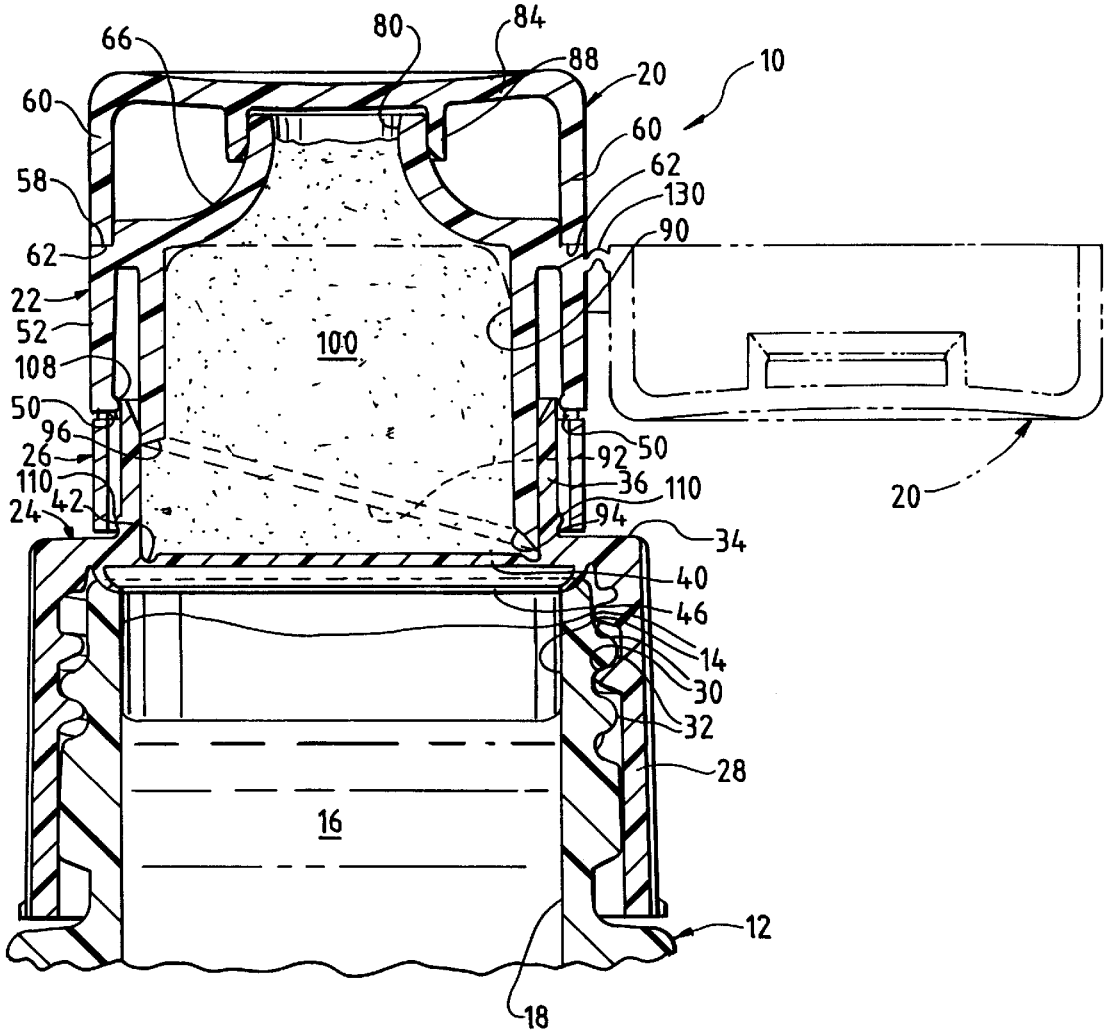
FIG. 4 is a cross-sectional view taken generally along the plane 4—4 in FIG. 1.

The container 12 may typically have a neck 18 (FIGS. 4 and 6) or other suitable structure defining the container mouth or opening 14 (FIG. 4). The neck 18 may have (but need not have) a circular cross-sectional configuration, and the body of the container 12 may have another cross-sectional configuration, such as an oval cross-sectional shape, for example. The container 12 may, on the other hand, have a substantially constant shape along its entire length or height without any neck portion of reduced size or different cross-section.

The container 12 may typically be a squeezable container having a flexible wall or walls which can be grasped by the user and compressed to increase the internal pressure within the container so as to squeeze the product 16 out of the container through the closure 10 when the closure 10 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container 12 may be substantially rigid.

The dispensing structure or closure 10 includes an outer lid 20, an underlying movable housing or cover 22, a base or body 24, and a tamper-evident band or tear band 26. According to one aspect of the invention, in some applications, the lid 20 and/or tear tab 26 may not be needed or required and could be omitted.

The closure base or body 24 defines a lower skirt 28 which has suitable connecting means (e.g., a conventional thread 30 as shown in FIG. 4) or a conventional snap-fit bead (not illustrated) for engaging a suitable container cooperating means, such as a thread 32 (or bead, not shown) to secure the closure base 24 to the neck 18 of the container 12.

The closure base 24 and container 12 could also be releasably attached by other means. Alternatively, the closure base 24 may be permanently attached to the container 12 by means of induction melting, ultrasonic melting, gluing, or the like, depending upon the materials employed for the container and closure. Further, as previously mentioned, the closure could, in some applications, be formed as a unitary part, or extension, of the container 12.

At the top of the closure skirt 28, the closure defines a radially inwardly extending, annular shoulder 34 (FIG. 4). Projecting outwardly (i.e., upwardly) from the shoulder 34 is an annular collar 36. The annular collar 36 may be characterized as defining an access aperture in the closure base 24. The access aperture is sealingly occluded by a membrane 40 which extends across the access aperture defined by the closure body collar 36. In the preferred embodiment illustrated, the membrane 40 is a unitary molded portion of the closure body 24. As seen in FIG. 4, the membrane 40 defines an outwardly (upwardly) facing, peripheral groove 42 forming a reduced thickness section having a circular locus on the periphery of the membrane 40 adjacent the inner, vertical, cylindrical surface of the collar 36. The reduced thickness section of material under the groove 42 around the periphery of the membrane 40 functions as a circular line of weakening which is more easily broken or severed when the closure is opened by a novel process described in detail hereinafter.

Preferably, an annular, flexible "crab's claw" shaped seal 46 (FIG. 4) projects from the lower portion of the closure body shoulder 34 adjacent the upper end of the container neck 18 so as to provide a leak-tight seal between the closure base 24 and the container neck 18. Of course, other types of closure base/container seals may be employed. Also, if air tightness is not required, no closure base/container seal 46 need be employed.

The container 12 and closure 10 may be normally stored in an upright orientation (as shown in the figures) wherein the closure 10 is at the top of the container. During such storage, the closure lid 20 may be either closed, or, in some cases, open. In some applications, a lid may not be necessary or required. If a lid 20 is employed, the container 12 and closure 10 could also be stored in an inverted position when the lid 20 is in the closed position. When the assembly is stored in the inverted position, the closure lid 20 functions as a support base.

Figure 5:
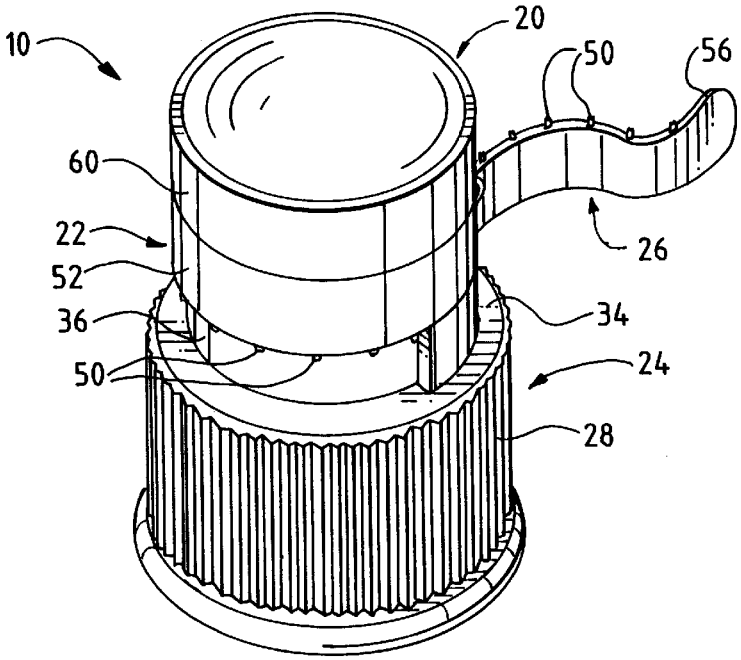
FIG. 5 is a view similar to FIG. 4, but FIG. 5 shows the tamper-evident band or tear band being torn away to permit relative movement between the dispensing closure cover and the dispensing closure body.

In the preferred embodiment, the tamperevident band or tear band 26 is mounted in a concentric manner around the closure body collar 36. The band 26 is attached at circumferentially spaced-apart locations to the closure body collar 36 with small, frangible members or bridges 50 (FIGS. 3, 4, and 5). Each frangible bridge 50 extends from the collar 36 and is connected to the top of the tear band 26 (preferably by unitary molding). Each bridge 50 is also connected to the bottom of an outer skirt 52 (FIG. 4) which defines the outer periphery of the closure cover 22 below the lid 20. The tear band 26 includes a finger graspable pull tab 56 (FIGS. 1, 2, 3, and 5) which can be grasped to pull the band 26 radially outwardly to break the frangible bridges 50 away from both the top of the closure body collar 36 and the bottom of the closure cover outer skirt 52 (as shown in FIG. 5).

Figure 2:
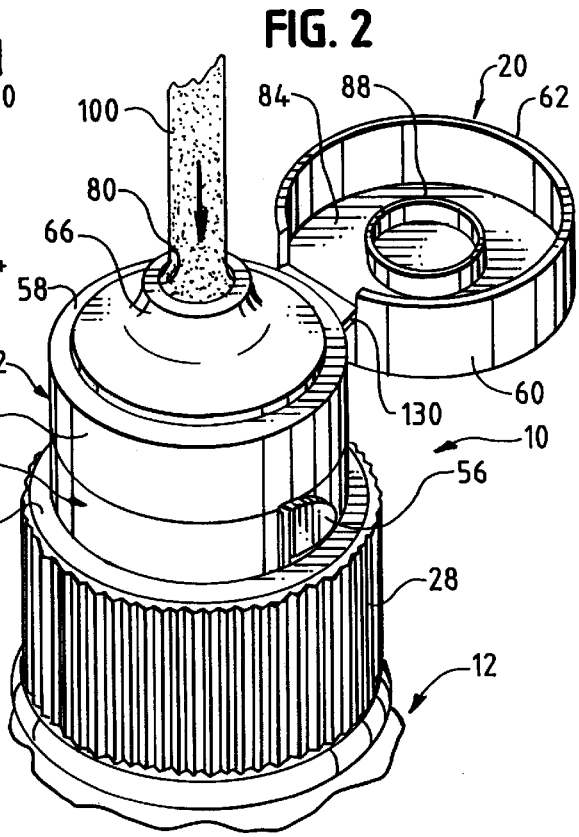
FIG. 2 is a view similar to FIG. 1, except that FIG. 2 shows the dispensing closure lid in a fully open position and shows a stream of additive material being poured through the dispensing closure housing or cover dispensing orifice into a receiving chamber.
Figure 3:
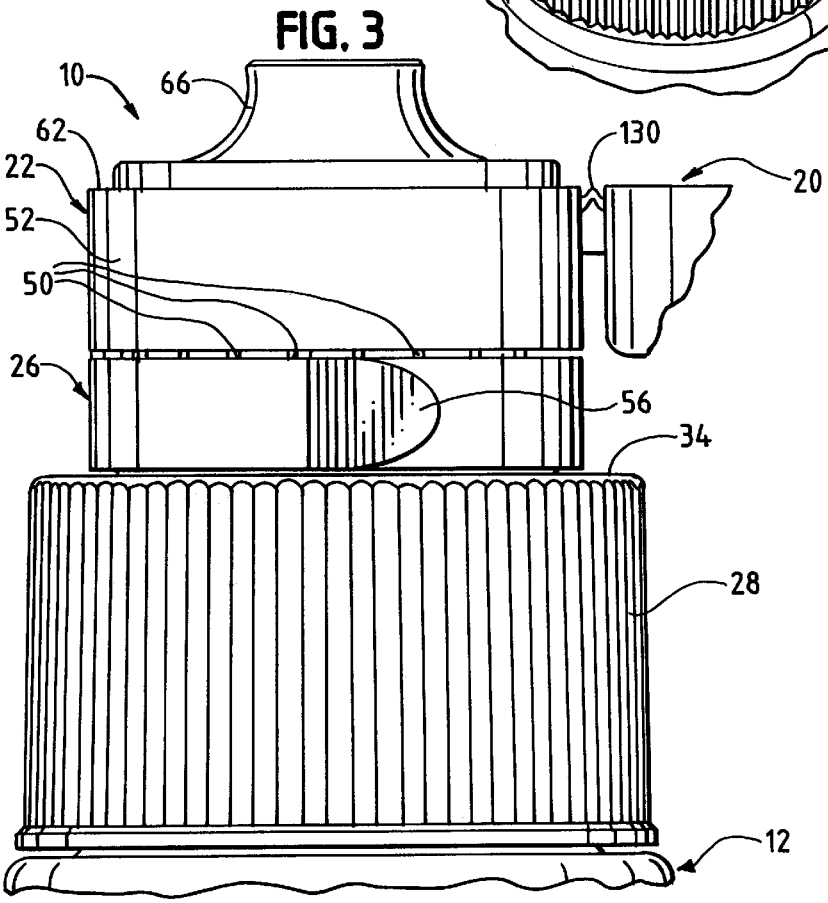
FIG. 3 is an enlarged, fragmentary side elevational view of the dispensing closure with the lid open.

The movable closure housing or cover 22 includes a recessed shoulder 58 at the upper end of the outer skirt 52 (FIGS. 2–4). The lid 20 includes a peripheral skirt 60 defining a downwardly facing, annular, seating surface 62 (FIG. 4) which is adapted to seat on the shoulder 58 at the top of the underlying cover outer skirt 52.

The closure cover 22 also preferably includes an upper spout 66 (FIGS. 2, 3, and 4). The spout 66 defines a dispensing orifice 80 (FIGS. 2 and 4). When the lid 20 is in the closed position (FIGS. 1, 4, 5, and 6), the dispensing orifice 80 is occluded by the lid. Preferably, as shown in FIGS. 2 and 4, the lid 20 includes a deck 84 at one end of the lid skirt 60, and a sealing collar or ring 88 projects from a central region of the deck 84 for sealingly engaging the exterior surface of the cover spout 66 when the lid 20 is in the closed position (FIGS. 4 and 6).

Figure 6:
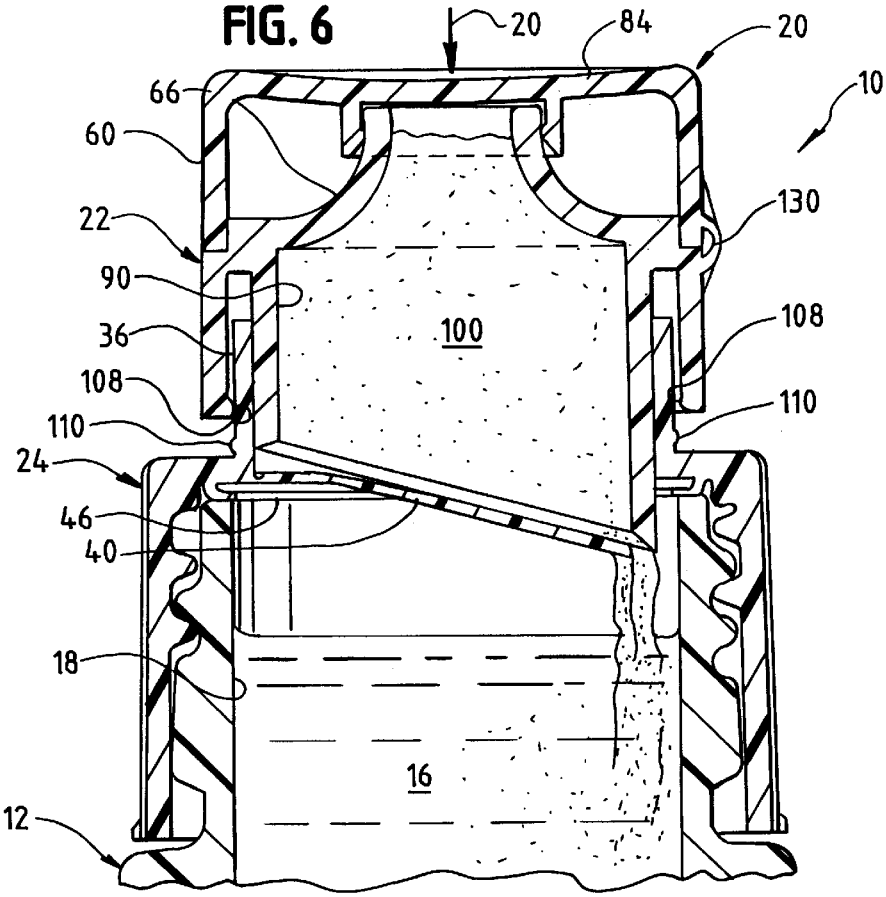
FIG. 6 is a view similar to FIG. 4, but FIG. 6 shows a downward force being applied to the closed lid so as to force lid and cover downwardly together relative to the closure body so as to sever the membrane.

The closure cover 22 also preferably includes an inner, annular wall 90 projecting downwardly or inwardly from the bottom end of the spout 66 (FIGS. 4 and 6). Preferably, the annular wall 90 has a generally cylindrical shape with a cylindrical exterior surface which is slidingly and sealingly engaged with the interior surface of the closure body collar 36. The cover annular wall 90 has a sloping or slanting bottom edge which lies at an oblique angle to the membrane 40. The edge 92 is relatively sharp at the lowermost part of the annular wall 90 as indicated by the reference number 94. (FIGS. 4 and 7) On the other hand, at the highest part of the bottom edge of the annular wall 90, the edge 92 is less angled (in the region indicated by the reference number 96) and is therefore not as sharp. The edge 92 is preferably designed to sever most, but not all, of the periphery of the membrane 40 at the groove 42 as described in detail hereinafter.

Because the closure cover annular wall 90 is sealingly engaged with the closure body collar 36, and because the lid 20 can be closed to occlude the cover dispensing orifice 80, a sealed chamber is defined within the cover 22 between the lid 20 at the upper end and the membrane 40 at the lower end. The chamber may be filled with an additive material 100, if desired. Subsequently, the membrane 40 can be severed (as described in detail hereinafter) so that the additive material 100 can be mixed with the product 16 within the container. For example, the additive material 100 may be a powder which is intended to be mixed with a liquid product 16 in the container to form a solution or mixture. Such a system may be especially desirable where two different materials are to be mixed together to form a useful composition, but where such materials must be stored separately prior to use because of chemical reactivity or physical incompatibility during the storage. Such resulting compositions may include, for example, health and beauty aids, cleaning compositions, dental formulas, food products, adhesives, paints, and especially compositions wherein the efficacy rapidly degrades with time following mixing.

FIG. 2 illustrates how the closure 10 may be initially filled with such an additive material 100. The manufacturer may open the closure lid 20 and then pour the additive material 100 through the dispensing orifice 80 until the chamber defined within the closure above the membrane 40 (FIG. 4) is filled with the desired amount of the material 100. This may be done before or after the closure 10 is mounted on the container 12.

Figure 7:
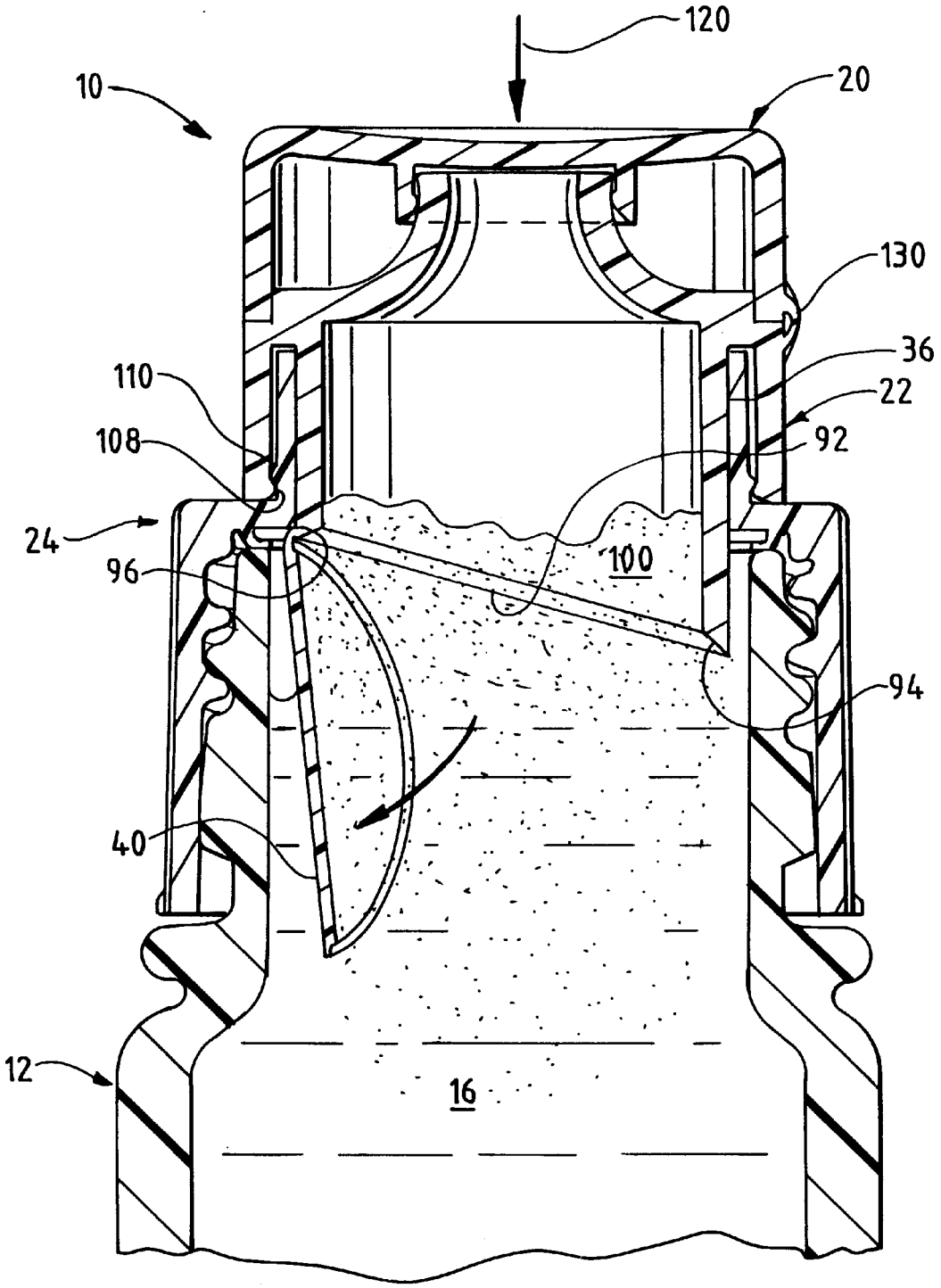
FIG. 7 is a view similar to FIG. 6, but FIG. 7 shows the lid and cover moved together to the fully lowered, or inwardly displaced, position wherein the partly severed membrane is substantially fully opened.
Figure 8:
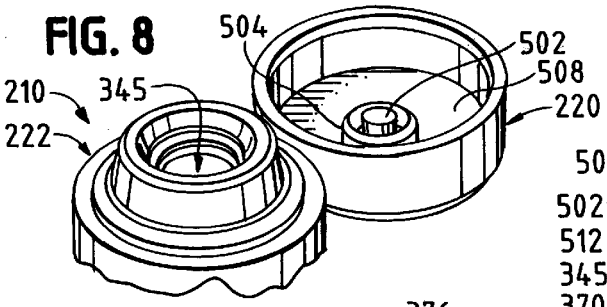
FIG. 8 is a perspective view of a second embodiment of a dispensing structure of the present invention.
Figure 10:
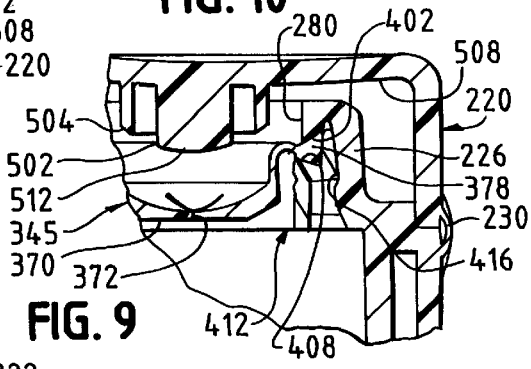
FIG. 10 is a fragmentary, cross-sectional view similar to FIG. 9, but FIG. 10 shows the lid in the fully closed position.

The closure 10 is adapted to be readily opened by the consumer. The closure cover 22 is adapted to slide between an elevated, unactuated position (FIGS. 1–5) and an inwardly displaced, actuated position (FIGS. 6 and 7). To this end, the closure cover outer skirt 52 includes a radially inwardly projecting bead 108 at the bottom of the skirt (FIGS. 4, 6, and 7). An outwardly projecting bead 110 is provided on the exterior of the closure body collar 36 at the bottom of the collar 36. The closure components are adapted to accommodate a small amount of radial deflection so that the beads 108 and 110 can be axially displaced past each other to form a snap-fit engagement (FIG. 10) when the closure cover 22 (and lid 20 carried thereon) is disclosed sufficiently inwardly (downwardly as shown in FIG. 7).

To fully open the closure 20, the tear tab 26 is first pulled away from the closure (as shown in FIG. 5) to break the frangible bridges 50 connecting the closure cover 22 and closure body collar 36. An axially downwardly acting force can be applied to the top of the lid 20 as indicated in FIGS. 6 and 7 by the arrow 120. A sufficiently high downward force causes the lid 20 and underlying cover 22 to move inwardly (downwardly) relative to the closure body 24.

As the cover 22 moves inwardly, the cover annular collar 90 moves inwardly toward the membrane 40. The edge 92 at the bottom of the cover collar 90 begins to engage the periphery of the membrane at the groove 42. Because the cover edge 92 is slanted at an oblique angle to the membrane 40, the membrane 40 is first severed at the location where the cover edge 92 is lowest. As the cover 22 and lid 20 are moved further inwardly toward the membrane 40, the periphery of the membrane 40 is further severed along the circular locus of the groove 42.

When the lid 24 and cover 22 are pushed to the fully inwardly displaced position (FIG. 7), the beads 108 and 110 effect a snap-fit engagement preventing the cover 22 from being pulled back outwardly. The leading portion of the cover severing edge 92 projects into the container neck well below the top of the container neck. On the other hand, the higher portion 96 of the severing edge 92 projects only slightly below the plane that defines the bottom of the membrane 40 when the membrane 40 is in the sealed, unsevered position. Further, because the higher region 96 of the severing edge 92 is not as sharp as the lower portions of the edge 92, and because the higher edge region 96 does not project very far downwardly, the membrane 40 is not severed adjacent the higher region 96 of the edge 92. Thus, the membrane 40 remains connected to the closure body 24 in this area.

However, because the higher region 96 of the cutting edge 92 projects slightly downwardly against the membrane 40, the membrane 40 is pushed generally downwardly into a substantially vertical orientation as shown in FIG. 7 to provide a generally unobstructed flow path between the container and the interior of the closure cover. Any additive material 100 in the closure cover can then fall into the container for mixing with the product 16 in the container. If the lid 20 is maintained in the closed position, the container 12 can be shaken to insure good mixing of the additive 100 with the product 16 in the container 12.

Subsequently, the lid 20 can be opened and the mixture can be dispensed by inverting the container 12. In the preferred embodiment, the lid 20 is connected to the closure cover 22 with a hinge 130 (FIGS. 1, 2, and 4). In a presently contemplated preferred embodiment, the hinge 130 is preferably a snap-action hinge having the configuration as disclosed in the U.S. Pat. No. 5,642,824. It will be appreciated, however, that the lid 20 need not to be hingedly connected to any other part of the closure. The lid 20 could be a separate element that is completely removable from the closure. Also, in some applications, such as where no additive product 100 is provided in the closure, it might be possible to eliminate the lid 20 altogether.

It will also be appreciated that in some applications, it may not be necessary or desirable to provide a tamper-evident tear band 26. If the band 26 is omitted, the frictional engagement between the closure cover annular wall 90 and the closure body collar 36 should be substantial so as to prevent unintended or inadvertent inward displacement of the closure cover 22 against the membrane 40. Such unintended or inadvertent inward displacement could be more readily prevented by incorporating a snap-fit engaging structure between the cover annular wall 90 and the body collar 36 when the cover 22 is in the elevated, unactuated position. Such a snap-fit engagement structure could include, for example, a groove in the inner surface of the wall of the collar 36 and a mating bead in the outer surface of the annular wall 90, or vice versa.

Instead of using a tear band 26 to provide tamper evidence, a shrink wrap film (not illustrated) may be applied around all or a portion of the closure 10 and/or container 12. Such a shrink wrap film could seal the closure 10 to the container 12 and could also seal the closure lid 20 to closure cover 22. Also, if the shrink wrap film is stiff enough, it might also be used to initially hold the closure cover 22 in the unactuated elevated position relative to the closure body 24 to prevent unintended actuation (opening of the membrane 46) until the shrink wrap film is first removed by the user.

The additive 100 may be initially provided in the closure 10 on the container 12, but the container 12 may be empty. For example, the container 12 might have a predetermined internal volume and may intended to be filled with a common, readily available diluent, such as water. The additive 100 could be a more expensive, special material that is prepackaged in the closure 10 and which retains its efficacy during storage in the closure until the user desires to prepare a diluted solution. At that time, the closure 10 is unscrewed from the container 12, and the container 12 is then filled with a predetermined amount of diluent, such as water. Next, the closure 10 is screwed back onto the container 12 and actuated to sever the membrane 40 so that the additive 100 can be mixed with the diluent.

It is also contemplated that if an additive material 100 is used, such added material can be separately packaged in a bag (not illustrated) or other holder, and attached to the container 12 or closure 10. Further, the additive component or components could also be carried in an overcap (not illustrated) attached to the closure 10. The user could later place the additive inside the chamber in the closure 10. The user could then actuate the closure 10 to sever the membrane 40 and permit mixing of the additive 100 with the product 16 in the container 12. Such a packaging system and process might be desirable where the additive 100 is purchased separately from the container/closure assembly containing the product 16 but where the subsequent mixing of the additive 100 and product 16 should occur in a closed system to prevent splashing of the materials or of the resulting mixture which might damage the surroundings or cause harm if in contact with skin.

A second embodiment of the dispensing structure of the present invention is illustrated in FIGS. 8–14. The second embodiment of the dispensing structure is illustrated in FIGS. 8–14 in the form of a dispensing closure designated generally in FIGS. 8–14 by the reference number 210.

The dispensing structure 210 includes a base or body 224 which may have substantially the same structure as the body 24 of the first embodiment described above with reference to FIGS. 1–7.

The dispensing structure 210 also includes a movable housing or cover 222 which is mounted on the base 224 and which may be initially connected thereto with a tamper-evident band or tear band 226 (FIG. 9) in substantially the same manner as in the first embodiment illustrated in FIGS. 1–7 wherein the band 26 connects the closure body 24 to the movable housing or cover 22.

The second embodiment movable housing or cover 222 is generally similar to the first embodiment housing or cover 22 except that the upper end of the second embodiment cover 222 has a modified dispensing orifice region which contains a pressure-openable, self-sealing, slit-type dispensing valve 345 which is described in detail hereinafter.

The second embodiment of the dispensing structure 210 also preferably includes a lid 220 which is preferably connected with a snap-action type hinge 230, such as the hinge having a configuration as disclosed in the U.S. Pat. No. 5,642,824, the disclosure of which is incorporated herein by reference thereto.

Figure 9:
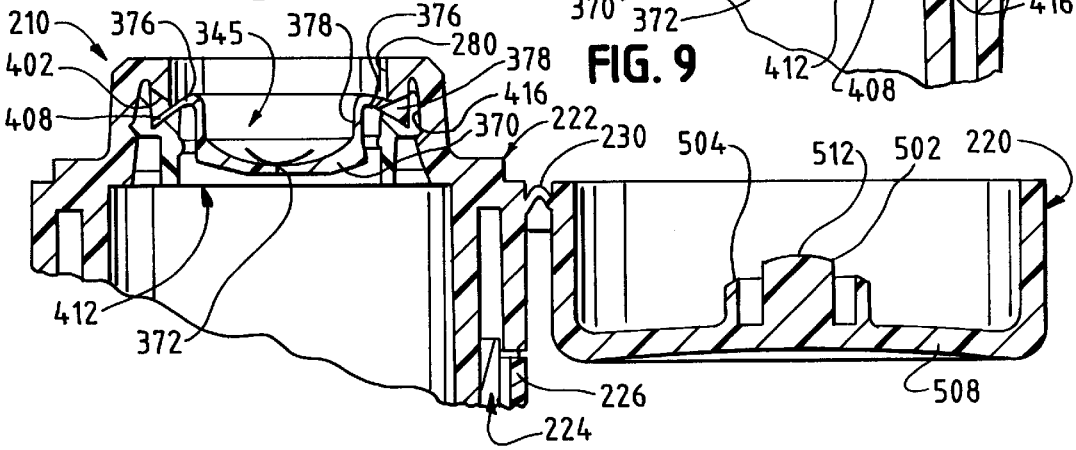
FIG. 9 is a greatly enlarged, fragmentary, cross-sectional view taken generally along the plane 9—9 in FIG. 8.

The cover 222 preferably includes an upper spout 266 defining a dispensing orifice 280 which is normally occluded by the closed valve 345 (FIG. 9).

Figure 11:
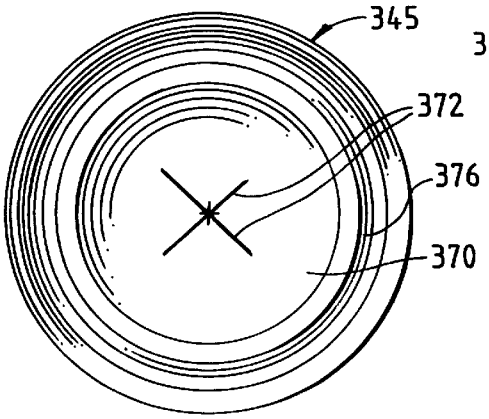
FIG. 11 is a top plan view of a self-sealing, pressure-openable, slit-type valve that is mounted within the second embodiment of the dispensing structure that is illustrated in FIGS. 8–10.
Figure 12:
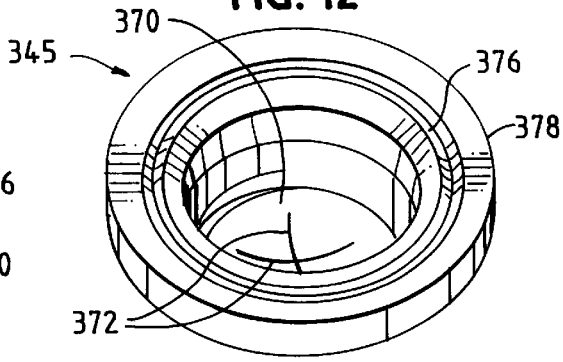
FIG. 12 is a perspective view of the valve illustrated in FIG. 11.
Figure 13:
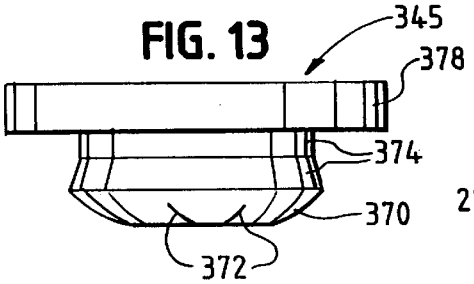
FIG. 13 is a side elevational view of the valve illustrated in FIGS. 11 and 12.

The preferred form of the valve 345 is illustrated FIGS. 11–13. The valve 345 is of a known design employing a flexible, resilient material which can open to dispense the product. The valve 345 may be molded from a suitable thermosetting elastomeric material, such as natural rubber and the like. Preferably, however, the valve 345 is molded from a thermoplastic elastomer based upon materials such as thermoplastic propylene, ethylene, polyurethane, and styrene, including their halogenated counterparts.

A valve which is similar to, and functionally analogous to, valve 45 is disclosed in the U.S. Pat. No. 5,439,143. However, the preferred form of the valve 345 employed in the present invention has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

Figure 14:
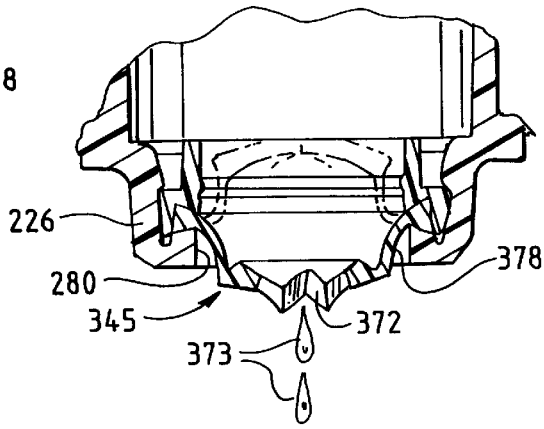
FIG. 14 is a fragmentary, cross-sectional view of the second embodiment of the dispensing structure shown inverted and in a dispensing mode.

As illustrated in FIGS. 11–13, the valve 345 includes a flexible, central wall or face 370 which has a concave configuration (when viewed from the exterior of the dispensing structure or closure cover 222) and which defines at least one, and preferably two, dispensing slits 372 extending through the central wall or face 370. A preferred form of the valve 345 has two, mutually perpendicular, intersecting slits 372 of equal length. The intersecting slits 372 define four, generally sector-shaped flaps or petals in the concave, central wall 370. The flaps open outwardly from the intersection point of the slits 372 in response to increasing container pressure of sufficient magnitude in the well-known manner described in the U.S. Pat. No. 5,439,143 and as shown in FIG. 14 herein.

The valve 345 includes a skirt 374 (FIGS. 9 and 13) which extends outwardly from the valve central wall 370. At the outer (upper) end of the skirt 374 there is a thin, annular flange 376 (FIGS. 9 and 12) which extends peripherally from the skirt 374. The thin flange 376 terminates in an enlarged, much thicker, peripheral flange 378 which has a generally dovetail shaped transverse cross section.

As shown in FIG. 9, the valve 345 is mounted within the closure cover 222. To this end, the upper portion of the closure cover spout 226 includes downwardly facing, frustoconical clamping surface 402 for engaging the upper surface of the valve flange 378. The bottom surface of the valve flange 378 is clamped by an upwardly facing, frustoconical surface 408 defined on a retainer ring 412 which is snap-fit into a receiving groove 416 defined on the inside of the spout 226. When the valve 345 is properly mounted within the cover 222 as illustrated in FIGS. 8, 9, 10, and 14, the central wall 370 of the valve 345 lies recessed below the cover dispensing orifice 280 defined by the cover spout 226.

The dispensing structure 210 is mounted to, or formed as part of, the container prior to the delivery of the package to the user. If a lid 220 is included, the lid 220 is in a closed condition, and the lid 220 then functions as a dust cover and also provides protection against accidental contact with the valve 345. The lid 220 provides these protective functions during shipping of the package, during warehousing, and while the package is on display in a store or while the package is initially being stored by the user.

The user may pivot the lid 220 to the full open position (or completely remove the lid 220 if it is not hingedly attached) so as to be able to inspect the condition of the valve 345 and/or dispense the container contents (after removing the tear tab and pushing the cover down to sever the membrane across the container in the same manner as illustrated for the first embodiment in FIG. 7).

After the membrane across the container opening has been severed, the mixed product within the container can be dispensed by inverting the container and squeezing it to increase the pressure within the container above ambient. This forces the mixed product within the container toward the valve 345 and forces the valve 345 from the recessed or retracted position (illustrated in phantom with dashed lines in FIG. 14) toward an outwardly extending position (illustrated in solid lines in FIG. 14). The outward displacement of the concave, central wall 370 of the valve 345 is accommodated by the relatively thin, flexible, skirt 378. The skirt 378 moves from an inwardly projecting, self-sealing, rest position to an outwardly displaced, pressurized position, and this occurs by the skirt 378 "rolling" outwardly toward the outside of the cover spout 226 (toward the position illustrated in solid lines in FIG. 14). However, the valve 345 does not open (i.e., the slits 372 do not open) until the valve central wall 370 has moved substantially all the way to a fully extended position located at or beyond the dispensing passage 280 defined at the end of the spout 226. Indeed, as the valve central wall 370 moves outwardly, the valve central wall 370 is subjected to radially inwardly directed compression forces which tend to further resist opening of the slits 372. Further, the valve central wall 370 generally retains its concave configuration as it moves outwardly and even after it reaches the fully extended position. However, when the internal pressure becomes sufficiently high, then the slits 372 of the valve 345 begin to open to dispense a stream of product or drop of product 373 as shown in FIG. 14. The product is expelled or discharged through the open slits 372.

The lid 220 may include a structure for preventing discharge of the container product through the valve 345 when the lid is closed and the container is inadvertently squeezed or subjected to impact forces which would increase the pressure within the container. In particular, a spud or seal post 502 and surrounding ring 504 may be provided on a central panel 508 of the lid 220 to project inwardly toward the valve 345 from the lid central panel 508.

The post 502 can have a generally cylindrical configuration, either solid or hollow. The post 502 preferably terminates in an outwardly convex distal end surface 512 that conforms generally to the concave configuration of the outer surface of the valve central wall 370. However, even when the lid 220 is closed, the post distal end surface 512 is spaced outwardly from the valve central wall 370 by a small amount which accommodates an initial, small, outward displacement of the valve central wall 370 into engagement with the post distal end surface 512 before the valve slits 372 can open. Thus, when the closed container is subjected to external forces which increase the container internal pressure, the valve central wall 370 is forced outwardly against the conforming end surface 512 of the seal post 502. This occurs inwardly of the outermost position at which the valve slits 372 would open. The ring 504 may also be contacted by a peripheral portion of the valve 345, and this may assist in preventing excessive outward movement of the valve 345. Thus, the valve 345 remains sealed closed in such over-pressure situations.

In a contemplated design employing such a seal post 502 and ring 504, as the valve 345 articulates or moves outwardly from the fully recessed position illustrated in dashed lines in FIG. 14 to a more outwardly position, the periphery of the valve central wall 370 and portion of the skirt 374 may tend to be compressed slightly in the radially inwardly direction to accommodate the movement of the valve 345. The slight reduction in the diameters of portions of the valve may be characterized as somewhat of a "collapsing" motion which can occur around the distal end of the lid seal post 502 and which further facilitates the sealing of the valve 345 by the lid seal post 502. The sealing engagement between the seal post distal end surface 512 and the valve central wall 370 serves to provide a highly effective seal which prevents unwanted dispensing of product into the lid region of the closure.

Preferably, the lid seal post 502 is smooth and free of indentations or other structure which could collect unwanted product, and the smooth surface of the seal post 502 provides a highly effective sealing surface for engagement with the valve 345.

The outward movement of the valve central wall 370 from the recessed position to the more outwardly displaced position against the seal post 345 temporarily increases the internal volume of the system. This volume increase can reduce the rate of pressure increase or peak pressure, and this can help accommodate the over-pressure condition resulting from external impact forces during shipping or handling.

Another, somewhat similar structure in a lid for preventing the valve from opening when the lid is closed is disclosed in U.S. Pat. No. 5,213,236. This may be preferable in some applications. In other designs, the lid 220 need not necessarily have any structure for engaging the valve to inhibit opening of the valve during accidental overpressure incidents.

In a preferred embodiment, the cover 222, lid 220, and hinge 230 are molded from a first material, such as polypropylene, and the valve 345 is molded from a second material, such as a thermoplastic elastomer. The use of a thermoplastic elastomer for injection molding the valve 345 is desirable in many applications because a thermoplastic elastomer provides suitable characteristics which accommodate the desired opening and closing of the valve 345 in response to the container interior pressure changes.

The use of a valve 345 is advantageous in that the contents of the container cannot be spilled from the container if it is accidentally knocked over by the user. When such a valve is employed, the lid may be omitted altogether. If a lid is employed, it may be completely removable from the cover or may be hingedly connected thereto as illustrated in the embodiment shown in FIGS. 8–14.

If a lid is not employed, it may be desirable for the manufacturer to apply a small piece of adhesive film or liner material over the top of the spout to prevent inadvertent leakage during transportation and handling.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing structure for a container that has an opening to the container interior, said dispensing structure being in the form of a dispensing closure comprising:

a body for being mounted to said container around said container opening and defining an access aperture for access to said container opening;

a membrane sealing said access aperture closed;

a cover disposed over said membrane and sealingly engaged with said body to accommodate axial sliding movement from an outer position to an inwardly displaced position, said cover defining a dispensing orifice and defining an edge for severing at least part of said membrane as said cover is non-rotatably moved from said outer position to said inwardly displaced position, said cover and said body together defining a chamber over said membrane;

an additive product in said chamber for adding to said container after at least part of said membrane is severed;

a removable tamper-evident band initially secured to said cover to prevent movement of said cover toward said inwardly displaced position until said band is torn at least partly away from said cover; and a lid and a hinge connecting said lid to said cover for accommodating movement of said lid between (1) a closed position over said cover dispensing orifice to close said orifice, and (2) an open position away from said lid closed position.

2. The dispensing structure in accordance with claim 1 in which said closure body includes a lower skirt with an internal thread for threadingly engaging an external thread on said container.

3. The dispensing structure in accordance with claim 2 in which said closure body includes an annular shoulder at the upper end of said lower skirt;

said closure body includes an annular collar which extends outwardly from said shoulder in a direction opposite from said lower skirt and which has a lower portion defining said access aperture; and said membrane extends across said access aperture at the lower portion of said annular collar as a unitary molded part of said closure body.

4. The dispensing structure in accordance with claim 3 in which said closure cover includes an inner, annular wall; and said cover edge is defined along a bottom portion of said cover inner, annular wall at an oblique angle to said membrane.

5. The dispensing structure in accordance with claim 4 in which said closure cover includes an outer skirt spaced radially beyond, and concentric with, said cover inner annular wall; and said cover outer skirt is adapted to be oriented concentric with, and on the exterior of, said closure body collar when said cover is in said inwardly displaced position.

6. The dispensing structure in accordance with claim 5 in which said closure cover outer skirt includes an annular bead; and said closure body annular collar includes an annular bead for effecting a snap-fit engagement with said cover outer skirt annular bead when said cover is in said inwardly displaced position.

7. The dispensing structure in accordance with claim 1 in which said closure cover includes an upwardly projecting spout defining said dispensing orifice; and said lid includes a ring adapted to sealingly engage an exterior surface of said spout when said lid is in said closed position.

8. The dispensing structure in accordance with claim 1 further including a pressure-openable, slit-type, self-sealing valve mounted within said cover at said dispensing orifice to control flow through said orifice.

9. A dispensing structure for a container that has an opening to the container interior, said dispensing structure comprising:

a body for extending around said container opening;

a membrane for occluding said container opening;

a cover disposed over said membrane and sealingly engaged with said body to accommodate axial sliding movement from an outer position to an inwardly displaced position, said cover defining a dispensing orifice and defining an edge for severing at least part of said membrane as said cover is moved from said outer position to said inwardly displaced position; and a removable tamper-evident band initially secured to said cover to prevent movement of said cover toward said inwardly displaced position until said band is torn at least partly away from said cover;

said body including a collar extending outwardly around said membrane;

said band being located generally concentric with, and radially beyond, said collar;

said cover including an outer skirt; and said dispensing structure further including frangible members connecting said band to said cover outer skirt.

10. A dispensing structure for a container that has an opening to the container interior, said dispensing structure comprising:

a body for extending around said container opening;

a membrane for occluding said container opening;

a cover disposed over said membrane and sealingly engaged with said body to accommodate axial sliding movement from an outer position to an inwardly displaced position, said cover defining a dispensing orifice and defining an edge for severing at least part of said membrane as said cover is moved from said outer position to said inwardly displaced position; and a removable tamper-evident band initially secured to said cover to prevent movement of said cover toward said inwardly displaced position until said band is torn at least partly away from said cover;

said cover including an inner, annular wall;

said cover edge being defined along a bottom portion of said cover inner, annular wall at an oblique angle to said membrane;

said body including a collar extending outwardly around said membrane;

said collar being oriented concentric with said cover inner, annular wall and sealingly engaged with the exterior of said cover inner, annular wall;

said collar including a radially extending annular bead;

said cover including an outer skirt adapted to be oriented concentric with, and on the exterior of, said collar when said cover is in said inwardly displaced position; and said cover outer skirt including an annular bead for effecting a snap-fit engagement with said collar annular bead when said cover is in said inwardly displaced position.

11. A dispensing structure for a container that has an opening to the container interior, said dispensing structure comprising:

a body for extending around said container opening;

a membrane for occluding said container opening;

a cover disposed over said membrane and sealingly engaged with said body to accommodate axial sliding movement from an outer position to an inwardly displaced position, said cover defining a dispensing orifice and defining an edge for severing at least part of said membrane as said cover is moved from said outer position to said inwardly displaced position, said cover and said body together defining a chamber over said membrane;

an additive product in said chamber for adding to said container after at least part of said membrane is severed; and a lid for accommodating movement between (1) a closed position over said cover dispensing orifice to close said orifice, and (2) an open position away from said lid closed position;

a removable tamper-evident band initially secured to said cover to prevent movement of said cover toward said inwardly displaced position until said band is torn at least partly away from said cover; and said band being generally concentric with, and located radially beyond, said body collar.

12. The dispensing structure in accordance with claim 11 in which said dispensing structure includes frangible members extending from said band to connect said band with said cover skirt.

13. The dispensing structure in accordance with claim 11 in which said dispensing structure includes at least one frangible member attaching said removable tamper-evident band to said cover.

14. A dispensing structure for a container that has an opening to the container interior, said dispensing structure comprising:

a body for extending around said container opening;

a membrane for occluding said container opening;

a cover disposed over said membrane and sealingly engaged with said body to accommodate axial sliding movement from an outer position to an inwardly displaced position, said cover defining a dispensing orifice and defining an edge for severing at least part of said membrane as said cover is moved from said outer position to said inwardly displaced position, said cover and said body together defining a chamber over said membrane;

an additive product in said chamber for adding to said container after at least part of said membrane is severed; and a lid for accommodating movement between (1) a closed position over said cover dispensing orifice to close said orifice, and (2) an open position away from said lid closed position;

said cover including an inner, annular wall;

said cover edge being defined along the bottom portion of said cover inner, annular wall at an oblique angle to said membrane;

said body including a collar extending outwardly around said membrane;

said collar being oriented concentric with said cover inner, annular wall and sealingly engaged with the exterior of said cover annular wall;

said collar including a radially extending annular bead;

said cover including an outer skirt adapted to be oriented concentric with, and on the exterior of, said collar when said cover is in said inwardly displaced position; and said cover outer skirt including an annular bead for effecting a snap-fit engagement with said collar annular bead when said cover is in said inwardly displaced position.

15. A dispensing structure for a container that has an opening to the container interior, said dispensing structure comprising:

a body for extending around said container opening;

a membrane for occluding said container opening;

a cover disposed over said membrane and sealingly engaged with said body to accommodate axial sliding movement from an outer position to an inwardly displaced position, said cover defining a dispensing orifice and defining an edge for severing at least part of said membrane as said cover is moved from said outer position to said inwardly displaced position, said cover and said body together defining a chamber over said membrane;

an additive product in said chamber for adding to said container after at least part of said membrane is severed; and a lid for accommodating movement between (1) a closed position over said cover dispensing orifice to close said orifice, and (2) an open position away from said lid closed position; and said dispensing structure including a hinge connecting said lid with said cover.

* * * * *